US011330362B2

(12) United States Patent
Nozaki et al.

(10) Patent No.: US 11,330,362 B2
(45) Date of Patent: May 10, 2022

(54) ACOUSTIC DEVICE

(71) Applicant: YAMAHA CORPORATION, Hamamatsu (JP)

(72) Inventors: Akihiko Nozaki, Hamamatsu (JP); Tsunenori Sano, Hamamatsu (JP); Masao Noro, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 57 days.

(21) Appl. No.: 16/809,639

(22) Filed: Mar. 5, 2020

(65) Prior Publication Data

US 2020/0204905 A1 Jun. 25, 2020

Related U.S. Application Data

(63) Continuation of application No. PCT/JP2018/020003, filed on May 24, 2018.

(30) Foreign Application Priority Data

Sep. 7, 2017 (JP) ..... JP2017-172234

(51) Int. Cl.
*H04R 1/26* (2006.01)
*H04R 1/28* (2006.01)
*H04R 3/14* (2006.01)

(52) U.S. Cl.
CPC ..... *H04R 1/26* (2013.01); *H04R 1/2876* (2013.01); *H04R 3/14* (2013.01)

(58) Field of Classification Search
CPC . H04R 1/20; H04R 1/227; H04R 1/24; H04R 1/32; H04R 1/323; H04R 1/40; H04R 1/403; H04R 1/023
See application file for complete search history.

(56) References Cited

U.S. PATENT DOCUMENTS 6,643,377 B1 * 11/2003 Takahashi ..... H04S 1/00 181/155
2008/0260174 A1 10/2008 Yokota
(Continued)

FOREIGN PATENT DOCUMENTS

CN 1989783 A 6/2007
CN 101304621 A 11/2008
(Continued)

OTHER PUBLICATIONS

Olson, Harry F. Elements of Acoustical Engineering. New York: D. Van Nostrand, 1940. pp. 119-133 (Year: 1940).*
(Continued)

*Primary Examiner* — Kile O Blair

(74) *Attorney, Agent, or Firm* — Rossi, Kimms & McDowell LLP

(57) ABSTRACT

Provided is an acoustic device with which it is possible to make reproduced sound able to be heard across a wide frequency range, from the front and from the rear. This acoustic device is provided with a flat speaker 3 configured to emit sound, from a front and a rear thereof, in a low frequency sound range. Also, provided therein are a first speaker 5F configured to emit sound, in a direction facing the front of the flat speaker, in a mid-to-high frequency sound range, and a second speaker 5R configured to emit sound, in a direction facing the rear of the flat speaker, in the mid-to-high frequency sound range.

4 Claims, 5 Drawing Sheets

(56) References Cited

U.S. PATENT DOCUMENTS

| | | | |
|---|---|---|---|
| 2013/0243225 | A1 | 9/2013 | Yokota |
| 2015/0146898 | A1 | 5/2015 | Sakanashi |

FOREIGN PATENT DOCUMENTS

| | | | |
|---|---|---|---|
| CN | 101867856 | A | 10/2010 |
| CN | 206100359 | U | 4/2017 |
| JP | S5524859 | U | 2/1980 |
| JP | H04137994 | A | 5/1992 |
| JP | 2006287545 | A | 10/2006 |
| JP | 2008113194 | A | 5/2008 |
| WO | 2014021178 | A1 | 2/2014 |

OTHER PUBLICATIONS

Internet Archive Wayback Machine, Linkwitz Lab, Aug. 2016 http://web.archive.org/web/20160817143710/http://www.linkwitzlab.com/ (Year: 2016).*

Office Action issued in Chinese Appln. No. 201880052544.9 dated Mar. 31, 2021. English translation provided.

International Search Report issued in International Application No. PCT/JP2018/020003 dated Aug. 28, 2018. English translation provided.

Written Opinion issued in International Application No. PCT/JP2018/020003 dated Aug. 28, 2018.

Office Action issued in Chinese Appln. No. 201880052544.9 dated Nov. 18, 2021. English translation provided.

* cited by examiner

ACOUSTIC DEVICE

CROSS REFERENCE TO RELATED APPLICATIONS

The present application is a continuation application of International Application No. PCT/JP2018/020003, filed May 24, 2018, which claims a priority to Japanese Patent Application No. 2017-172234, filed Sep. 7, 2017. The contents of these applications are incorporated herein by reference in their entirety.

FIELD OF INVENTION

This invention relates to an acoustic device that emits sound bidirectionally.

BACKGROUND

At performance venues and the like, it is desirable that the sound of the performance that is emitted from speakers can be heard not only by listeners, but by performers as well. Accordingly, it is conceivable that performers may perform at positions between the sound-emitting sides of the speakers and the listeners. However, a problem with performing in this way is that some of the sound of the performance directed from the speakers towards the listeners is obstructed by the performers.

Thus, as a means of emitting the sound of a performance, a method is conceivable in which flat speakers are employed that bidirectionally emit sound from the front and from the rear thereof to allow the sound of the performance emitted from the front of the flat speakers to be heard by the listeners, and allow the sound of the performance emitted from the rear of the same flat speakers to be heard by the performers.

However, it is difficult for flat speakers to perform high-quality sound reproduction over a wide frequency band extending from low frequency to high frequency, and flat speakers are also unsuitable for use with performances in which musical instruments are played and music reproduction.

JP H4-137994A (hereinafter referred to as "Patent Literature 1") discloses a technique in which two speakers are arranged back-to-back, and one of the speakers is driven by a sound signal that is phase inverted from a sound signal that drives the other speaker.

SUMMARY OF INVENTION

The inventors of the present invention have investigated a method in which the technique in Patent Literature 1 is used such that both listeners and performers can hear the sounds of a performance. However, with the technique disclosed in Patent Literature 1, two speaker units that reproduce a full voice band including low frequencies are arranged back-to-back and each have a cone attached to the front thereof, and thus a problem arises in which the size of the speaker apparatus increases in the font-back direction.

As described above, there are no currently available acoustic devices that are suitable for use with performances in which musical instruments are played, musical reproduction, and the like, and are thin, light-weight, and able to provide reproduced sound separately to performers and listeners over a wide frequency band extending from low frequency to high frequency. Also, there are no available acoustic devices that are thin, light weight, and able to bidirectionally reproduce sound forward and rearward thereof over a wide frequency band extending from low frequency to high frequency, regardless of whether or not the acoustic device is used to provide reproduced sound separately to performers and listeners.

This invention was made in view of circumstances such as those described above, and an object thereof is to provide an acoustic device that is thin, light-weight, and able to provide reproduced sound over a wide frequency band extending from low frequency to high frequency, by emitting sound from the front and rear thereof.

One aspect of this invention is to provide an acoustic device including: a flat speaker configured to emit sound, from a front and a rear thereof, in a low frequency sound range; a first speaker configured to emit sound, in a direction facing the front of the flat speaker, in a mid-to-high frequency sound range; and a second speaker configured to emit sound, in a direction facing the rear of the flat speaker, in the mid-to-high frequency sound range.

With this acoustic device, both the front and rear of the same flat speaker emit sound in low frequencies, and therefore it is possible to provide low frequency reproduced sound forward and rearward of the acoustic device. Also, in regards to mid-to-high frequencies, sound is emitted by a first speaker configured to emit sound in mid-to-high frequency frequencies in the direction facing the front of the flat speaker, and a second speaker configured to emit sound in mid-to-high frequency frequencies in the direction facing the rear of the flat speaker. Accordingly, it is thus possible to provide reproduced sound over a wide frequency band extending from low frequency to high frequency from the front and from the rear of the acoustic device. Also, with this acoustic device, a flat speaker is employed as a means of emitting sound in low frequencies, and therefore it is possible to realize a thin and light-weigh acoustic device.

DETAILED DESCRIPTION OF THE PREFERRED EMBODIMENTS

The following is a description of embodiments of this invention with reference to the drawings.

Figure 1:
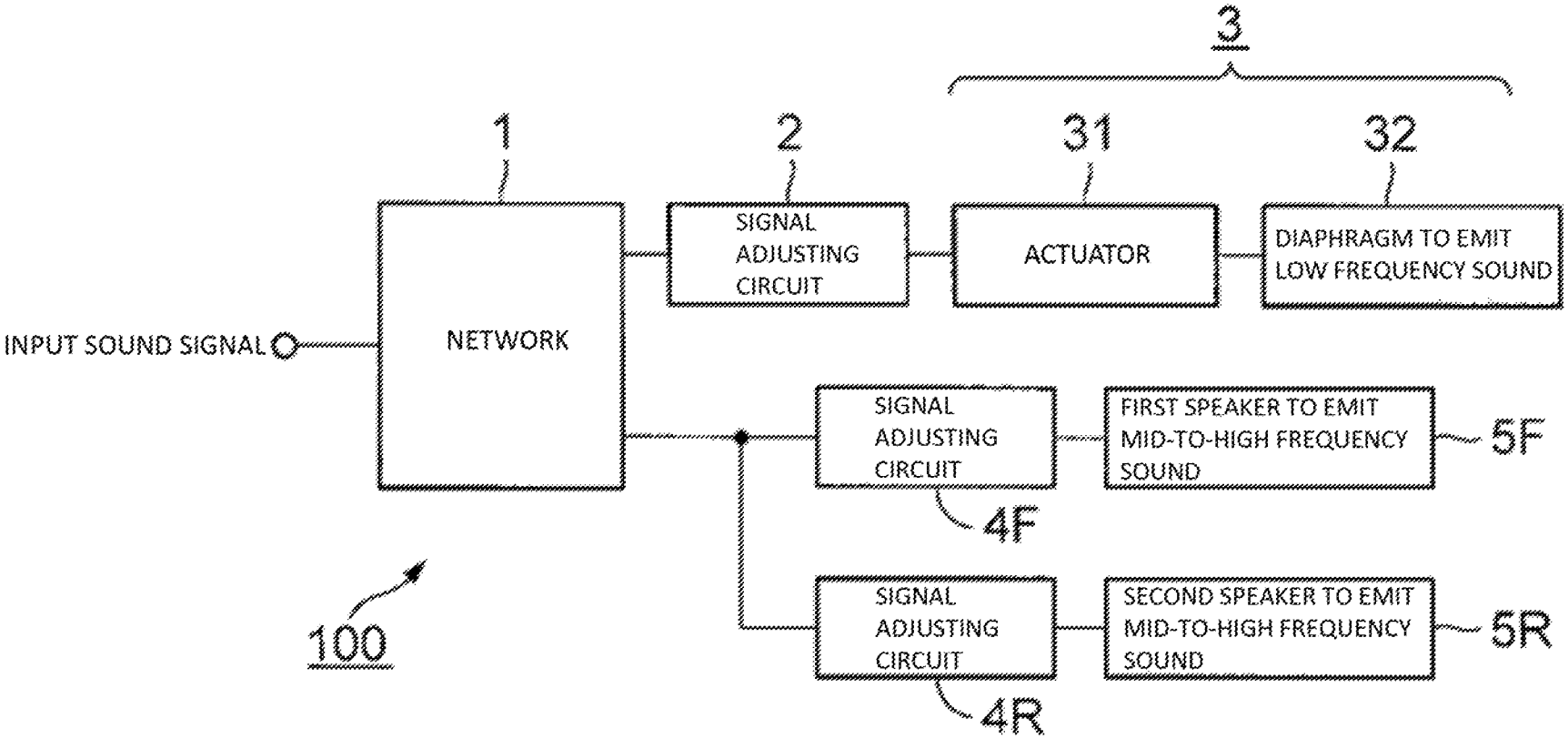
FIG. 1 is a block diagram showing an electrical configuration of an acoustic device of an embodiment of this invention.

FIG. 1 is a block diagram showing a configuration of an electrical system of an acoustic device 100 of an embodiment of this invention. In FIG. 1, a network 1 is a means for dividing an input sound signal, which is to be reproduced, into a mid-to-high frequency sound signal and a low frequency sound signal and outputting these signals.

A signal adjustment circuit 2 is a drive circuit that drives a flat speaker 3 configured to emit sound in a low frequency sound range, based on a low frequency sound signal that is supplied from the network 1. The signal adjustment circuit 2 includes an equalizer unit that adjusts the frequency characteristics of the low frequency sound signal that is supplied from the network 1, an amplifier unit that amplifies the low frequency sound signal that is output by the equalizer unit and drives the flat speaker 3, and a volume unit that adjusts the output level of the amplifier unit. In the adjustment circuit 2, in accordance with commands given by an operator that will be described later, the frequency characteristics of the reproduced sound that is emitted from the flat speaker 3 can be adjusted by the equalizer unit, and the volume can be adjusted by the volume unit. Actuators 31 drive a diaphragm 32 configured to emit sound in a low frequency sound range, based on an output signal from the signal adjustment circuit 2. The actuators 31 and the diaphragm 32 constitute the flat speaker 3. The actuators 31 drive the diaphragm 32 in both forward and rearward, and thus a plane-wave sound wave is produced from the front and the rear of the diaphragm 32, and sound is emitted from the front side and the rear side of the acoustic device 100.

A signal adjustment circuit 4F is a drive circuit that, based on a mid-to-high frequency sound signal that is output from the network 1, drives a first speaker 5F configured to emit sound in a mid-to-high frequency sound range that is provided on the front side of the acoustic device 100. A signal adjustment circuit 4R is a drive circuit that phase inverts the mid-to-high frequency sound signal that is output from the network 1 and drives a second speaker 5R configured to emit sound in a mid-to-high frequency sound range with use of the sound signal that has been phase inverted, the second speaker 5R being provided on the rear side of the acoustic device 100.

The signal adjustment circuits 4F and 4R are a part of an adjusting circuit for adjusting sound emission characteristics, and function to adjust the sound emission characteristics (volume and frequency characteristics of reproduced sound, specifically) of the first speaker 5F and the second speaker 5R.

More specifically, the signal adjustment circuit 4F includes an equalizer unit that adjusts the frequency characteristics of the mid-to-high frequency sound signal that is supplied from the network 1, an amplifier unit that amplifies a first sound signal for mid-to-high frequency sound reproduction that is output by the equalizer unit and drives the first speaker 5F, and a volume unit that adjusts the output level of the amplifier unit. In the signal adjustment circuit 4F, in accordance with commands given by an operator that will be described later, the frequency characteristics of the reproduced sound that is emitted from the first speaker 5F can be adjusted by the equalizer unit, and the volume can be adjusted the volume unit.

Also, the signal adjustment circuit 4R includes an equalizer unit that phase inverts the mid-to-high frequency sound signal that is supplied from the network 1 and adjusts the frequency characteristics thereof, an amplifier unit that amplifies a second sound signal for mid-to-high frequency sound reproduction that is output from the equalizer unit and drives the second speaker 5R, and a volume unit that adjusts the output level of the amplifier unit. In the signal adjustment circuit 4R, in accordance with commands given by an operator that will be described later, the frequency characteristics of the reproduced sound that is emitted from the second speaker 5R can be adjusted by the equalizer unit, and the volume thereof can be adjusted by the volume unit. Note that the functions of the equalizer unit for adjusting frequency characteristics may be shared with the signal adjustment circuit 4F and the signal adjustment circuit 4R.

Figure 2B:
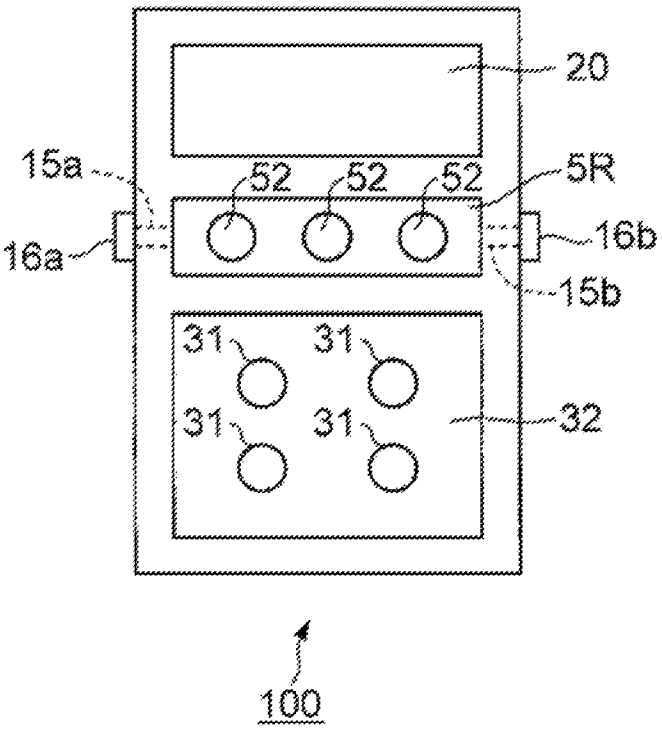
FIGS. 2A and 2B are each a diagram showing the front and rear of the acoustic device.
Figure 2A:
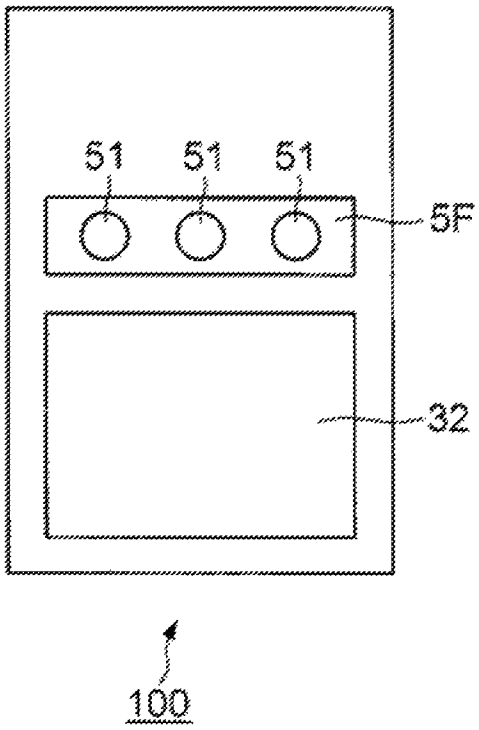

FIG. 2A is a front view of the acoustic device 100 according to the present embodiment as seen from the front side thereof, and FIG. 2B is a rear view of the same acoustic device 100 as seen from the rear side thereof.

As shown in FIG. 2A, the diaphragm 32 for low frequency sound reproduction is arranged in a region in approximately the lower half of the acoustic device 100. As shown in FIG. 2B, four actuators 31 are fixed to the rear of the diaphragm 32. Also, as shown in FIG. 2A, the first speaker 5F for mid-to-high frequency sound reproduction is arranged above the diaphragm 32 on the front of the acoustic device 100.

The first speaker 5F includes three speaker units 51 that are horizontally aligned. The speaker units 51 are driven by an output signal of the signal adjustment circuit 4F, and thus emit sound. The sound emission direction of the speaker units 51 is the same direction as facing the front of the diaphragm 32. Note that there may be any number of the speaker units 51.

As shown in FIG. 2B, the second speaker 5R for mid-to-high frequency sound reproduction is arranged above the diaphragm 32 for low frequency sound reproduction on the rear of the acoustic device 100.

The second speaker 5R includes three speaker units 52 that are horizontally aligned. The speaker units 52 are driven by the output signal of the signal adjustment circuit 4R, and thus emit sound. In the normal state, the sound emission direction of the speaker units 52 is the same direction as facing the rear of the diaphragm 32. However, in the present embodiment, it is possible to tilt the sound emission direction from the normal state by rotating rotary knobs 16*a* and 16*b* that will be described later.

There may be any number of speaker units 52 in the second speaker 5R. Also, the number of speaker units 52 in the second speaker 5R may be the same as, or may be different than, the number of speaker units 51 in the first speaker 5F. The diaphragm shape of the speaker units 51 and 52 may be flat, or may be cone-shaped. The speaker units 51 and 52 for mid-to-high frequency sound reproduction are small, and therefore even if the speaker units 51 and 52 are arranged back-to-back, the thickness thereof is not a problem in the acoustic device 100 as a whole. However, the positions of the speaker units 51 that include a sound emitting surface on the front side of the acoustic device 100, and the positions of the speaker units 52 that include a sound emitting surface on the rear side of the acoustic device 100 may be arranged out of alignment in a vertical plane. With this configuration, it is possible to make the acoustic device 100 even thinner.

In the second speaker 5R, support shafts 15*a* and 15*b* horizontally protrude from respective ends of the second speaker 5R in the horizontal direction thereof. The support shafts 15*a* and 15*b* pass through holes that are provided in the right side and left side surfaces of the housing of the acoustic device 100, and the rotary knobs 16*a* and 16*b* are respectively fixed to the leading ends of the support shafts 15*a* and 15*b* that protrude from the holes. The rotary knobs 16*a* and 16*b* function as an operator for adjusting the mode in which the second speaker 5R emits sound. Specifically, the performer can turn the rotary knobs 16*a* and 16*b* to adjust the sound emission direction of the second speaker 5R by, for example, raising or lowering the direction of the second speaker 5R to match the body type, posture, and preference of the performer.

An operator 20 is provided above the second speaker 5R on the rear of the acoustic device 100. The operator 20 is provided with various types of operators. These include operators for independently adjusting the volume and frequency characteristics of the reproduced sound of the first speaker 5F, the volume and frequency characteristics of the reproduced sound of second speaker 5R, and the volume and frequency characteristics of the reproduced sound of the flat speaker 3, operators used in operations related to audio amplification, and the like.

The foregoing has been a detailed description of the acoustic device according to the present embodiment.

In the present embodiment, the actuators 31 drive the diaphragm 32 for low frequency sound reproduction, based on a low frequency sound signal output from the signal adjustment circuit 2. As a result, low frequency reproduced sound is emitted with opposite phases in the directions facing the front and the rear of the acoustic device 100.

On the other hand, the signal adjustment circuit 4F drives the first speaker 5F for mid-to-high frequency sound reproduction based on a mid-to-high frequency sound signal that is output from the network 1. Also, the signal adjustment circuit 4R phase inverts the mid-to-high frequency sound signal that is output from the network 1, and drives the second speaker 5R for mid-to-high frequency sound reproduction based on the phase inverted sound signal. As a result, mid-to-high frequency reproduced sound is emitted with opposite phases in the directions facing the front and the rear of the acoustic device 100.

Accordingly, with the present embodiment, both listeners positioned in front of the acoustic device 100 and performers positioned behind the acoustic device 100 can hear the low frequency and mid-to-high frequency reproduced sound of the acoustic device 100.

Here, in accordance with the flat speaker 3 for low frequency sound reproduction emitting low frequency reproduced sound from the front and rear thereof in phases that are opposite to each other, the first speaker 5F and the second speaker 5R for mid-to-high frequency sound reproduction emit mid-to-high frequency reproduced sound from the front and rear thereof with phases that are opposite to each other. Accordingly, the listener positioned in front of the acoustic device 100 and the performer positioned behind the acoustic device 100 can both hear the reproduced sound made up of the same phases across a full frequency band. Note that the reproduced sound that is emitted forward from the acoustic device 100 and the reproduced sound that is emitted rearward from the acoustic device 100 are not heard by the same person, and therefore the fact that the reproduced sound has opposite phases on the front and rear of the acoustic device 100 is not a problem.

Also, in the present embodiment, the volume and frequency characteristics of the mid-to-high frequency reproduced sound that is emitted from the first speaker 5F, and the volume and frequency characteristics of the mid-to-high frequency reproduced sound emitted from the second speaker 5R can be individually and independently adjusted with use of the operator 20. Accordingly, it is possible to desirably adjust the sound emission characteristics of the mid-to-high frequency sound to be emitted toward both the listener and the performer. For example, if the distance from the acoustic device 100 to the performer is extremely short compared to the distance from the acoustic device 100 to the listener, it is necessary to turn down the volume of the sound emitted from the second speaker 5R, and such adjustment of the sound level is also possible.

Also, in the present embodiment, it is possible to adjust the sound emission direction of the second speaker 5R by operating the rotary knobs 16*a* and 16*b*. Accordingly, it is possible to emit mid-to-high frequency reproduced sound at a height that is preferable for the performer, such as the height of the ears of the performer who is close to the acoustic device 100, for example.

Also, with the present embodiment, the diaphragm 32 serves as a diaphragm body for low frequency sound reproduction, and therefore the thickness of the speaker for low frequency sound reproduction can be made thinner, and thus the acoustic device 100 can be made slim overall.

Other Embodiments

The foregoing has been a description of an embodiment of the present invention, but other embodiments of the present invention are also conceivable. Examples of the other embodiments are as follows. Also, the gist of the embodiments below may be combined as appropriate.

Figure 3B:
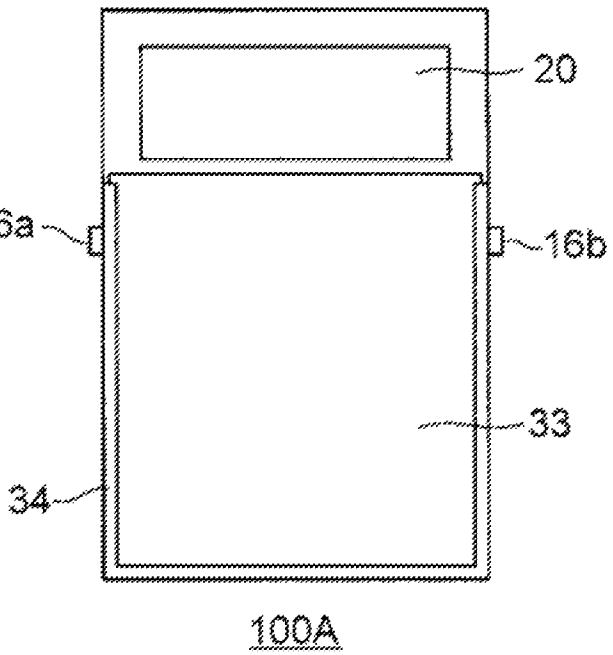
FIGS. 3A and 3B are each a diagram showing the rear of the acoustic device in another embodiment of this invention.
Figure 3A:
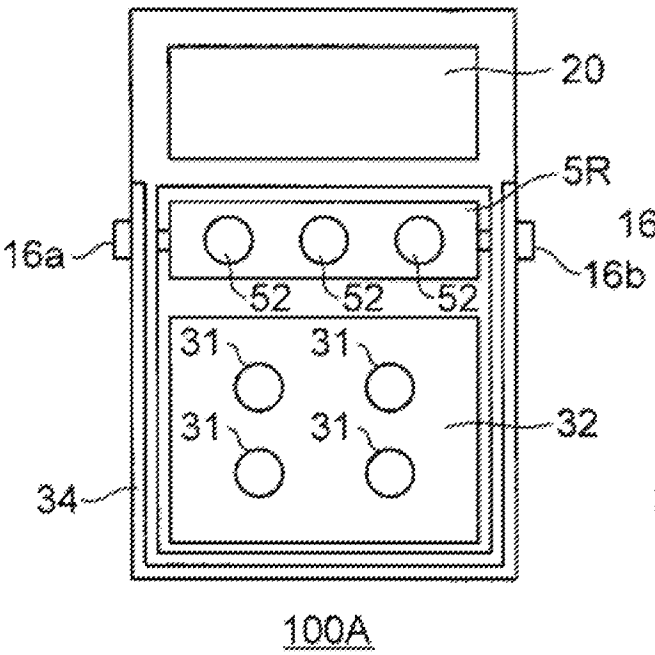

(1) FIG. 3A is a rear view of an acoustic device 100A according to another embodiment of this invention. Note that in FIG. 3A, the same reference numerals are used for portions corresponding to portions shown in the previously-mentioned FIG. 2B, and descriptions thereof are omitted. In the embodiment described above, the flat speaker 3 for low frequency sound reproduction emits sound from the front and the rear of the diaphragm 32, and therefore it is difficult to independently adjust the volume and frequency characteristics of the sound that is emitted forward and the sound that is emitted rearward of the flat speaker 3. There, with the mode shown in FIG. 3A, the rear surface of the housing of the acoustic device 100A is provided with a support frame 34 for housing the edges of a flat, rectangular sound absorption panel, in a region that surrounds three sides of the diaphragm 32 of the flat speaker 3 for low frequency sound reproduction and the second speaker 5R for mid-to-high frequency sound reproduction. FIG. 3B shows a state in which the bottom side, left side, and right side of the sound absorption panel 33 are housed in the support frame 34. By housing the sound absorption panel 33 in this way, the rear of the diaphragm 32 of the flat speaker 3 and the sound emitting surface of the second speaker 5R are covered by the sound absorption panel 33. As a result, the sound absorption panel 33 functions as an adjusting circuit for adjusting sound emission characteristics, thus adjusting the volume and frequency characteristics of low frequency and mid-to-high frequency reproduced sound emitted from the rear of the acoustic device 100A. Different kinds of the sound absorption panel 33 with different characteristics may be prepared, and a desired panel can be selected and used as an adjusting circuit for adjusting sound emission characteristics. Thus, it is possible to adjust the sound emission characteristics of the rear of the diaphragm 32 and of the second speaker 5R to desired characteristics.

Figure 4:
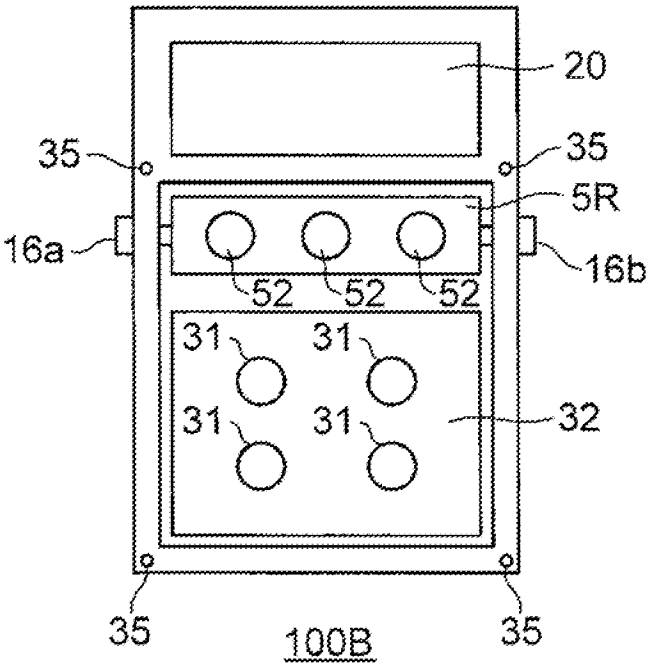
FIG. 4 is a diagram showing the rear of the acoustic device in another embodiment of this invention.

(2) An acoustic device 100B shown in FIG. 4 is a modification of the mode of FIG. 3A. The rear of the housing of the acoustic device 100B is not provided with the support frame 34 shown in FIG. 3A. Instead, the rear of the housing of the acoustic device 100B is provided with four panel connection holes 35 in four corner points of the rectangular region occupied by the diaphragm 32 for low frequency sound reproduction and the second speaker 5R for mid-to-high frequency sound reproduction. A rectangular sound absorption panel has elastic protrusions (not shown) that are provided on the four corner points thereof which are configured to be press-fitted into the four panel connection holes 35, and thus the sound absorption panel is supported on the rear of the housing of the acoustic device 100B. Accordingly, in this mode as well, an effect similar to the mode shown in FIG. 3A can be obtained.

(3) Instead of the support frame 34 as shown in FIG. 3A and the panel connection holes 35 as shown in FIG. 4 being provided, a sound absorption panel may also be attached to the rear of the housing of the acoustic device with use of a hook-and-loop fastener and the like.

(4) With the embodiment described above, the signal adjustment circuit 4F, which adjusts the sound emission characteristics (the volume and frequency characteristics of the reproduced sound, specifically) of the first speaker 5F, and the signal adjustment circuit 4R, which adjusts the sound emission characteristics of the second speaker 5R, are provided as an adjusting circuit for adjusting sound emission characteristics. However, an adjusting circuit may also be provided for adjusting only the sound emission characteristics of the second speaker 5R. Also, with the modes (1) and (2) described above, the sound absorption panel adjusts the sound emission characteristics of the rear of the diaphragm 32 for low frequency sound reproduction and the second speaker 5R for mid-to-high frequency sound reproduction. However, instead of this, a configuration is also possible in which the sound absorption panel adjusts the sound emission characteristics of only either the rear of the diaphragm 32 or the second speaker 5R.

(5) With the embodiment described above, the speaker units 51 and 52 are provided above the diaphragm 32 for low frequency sound reproduction, but there is no limitation to the positioning of the speaker units 51 and 52. The speaker units 51 and 52 may also be provided at a position other than above the diaphragm 32.

(6) Not only control functions related to the frequency characteristics and volume and the like of sound, but also control functions for image reproduction may be added, and by providing an image display unit on the performer's side (the rear side in the embodiment described above), the present invention may be configured as a Karaoke machine primarily for outdoor use.

(7) The present invention may be configured as a simple electronic musical instrument by providing a sound source and a performance operator such as a keyboard inside the acoustic device according to the embodiment described above. A common portable electronic keyboard instrument mostly emits sound in the forward direction thereof, but this simple electronic musical instrument has the merit of being able to provide reproduced sound of the same scale to a performer and a listener at the same time.

Figure 5:
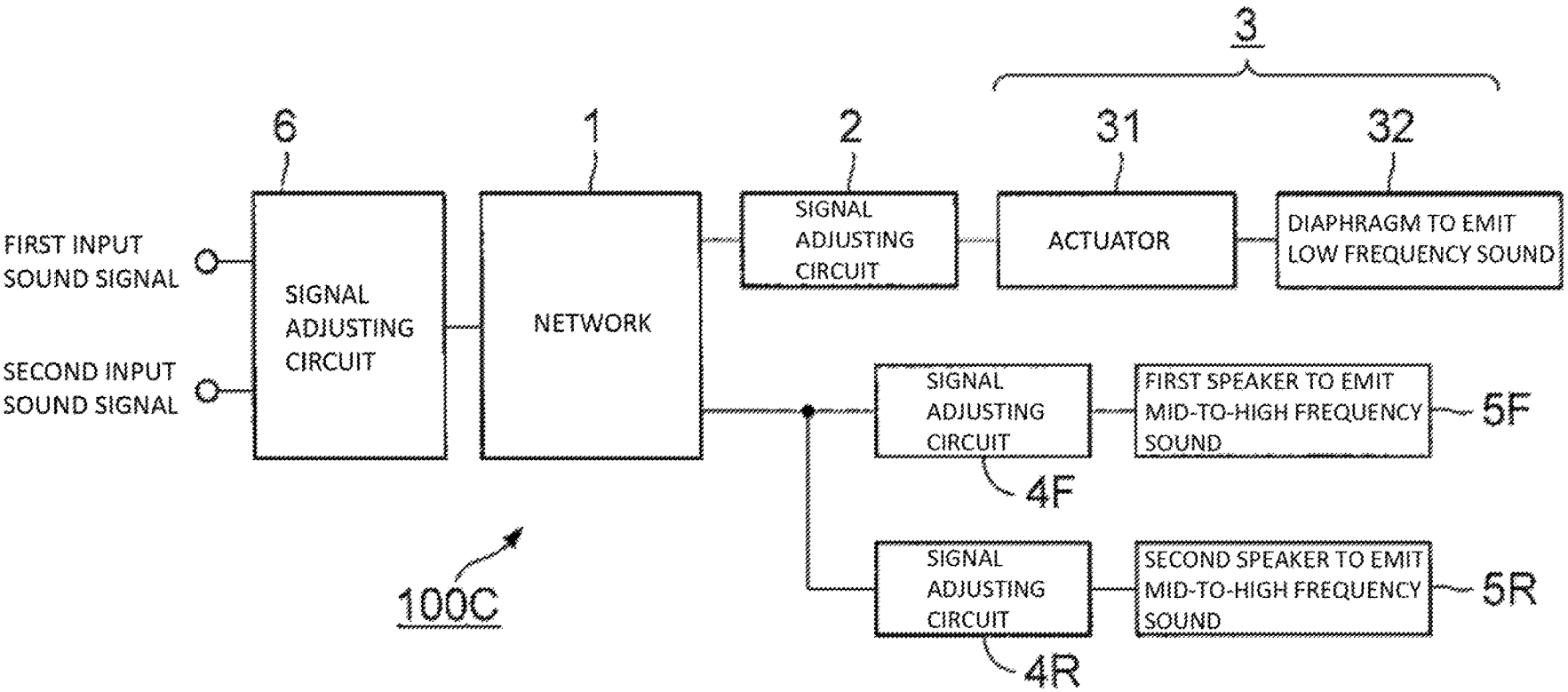
FIG. 5 is a block diagram showing an electrical configuration of the acoustic device in another embodiment of this invention.

(8) A signal adjustment circuit for adjusting the overall volume and frequency characteristics, either instead of or in addition to, adjusting the sound signal which is the sound to be emitted independently for every frequency band, or independently for the front and the rear, may also be provided in an input stage (before the network 1). FIG. 5 is a block diagram showing an example configuration of such an acoustic device. An acoustic device 100C as shown in FIG. 5 includes a signal adjustment circuit 6 in a stage before the network 1 in the acoustic device 100 according to the embodiment described above (FIG. 1). With this mode, signal adjustment of only the low frequency sound signal can be performed by the signal adjustment circuit 2, signal adjustment of only the mid-to-high frequency sound signal to be emitted forward of the acoustic device 100C can be performed by the signal adjustment circuit 4F, and signal adjustment of only the mid-to-high frequency sound signal to be emitted rearward of the acoustic device 100C can be performed by the signal adjustment circuit 4R. In addition, with this mode, the overall volume and frequency characteristics of the acoustic device 100C can be adjusted by the signal adjustment circuit 6. Also, with this example, the signal adjustment circuit 6 also functions as a mixer that mixes and supplies a first input sound signal and a second input sound signal to the network 1. In this acoustic device 100C, a part that corresponds to the operator 20 in the embodiment described above is provided with an operator for designating the mixing ratio and the like of this mixer. Accordingly, with this mode, it is possible to mix and emit a multi-channel sound signal in a desired mode.

LIST OF REFERENCE NUMERALS

100, 100A, 100B, 100C Acoustic device
1 Network
3 Flat speaker to emit sound in a low frequency sound range
31 Actuator
32 Diaphragm for low frequency sound reproduction
2, 4F, 4R, 6 Signal adjustment circuit
5F First speaker to emit sound in a mid-to-high frequency sound range
5R Second speaker to emit sound in a mid-to-high frequency sound range
51, 52 Speaker unit
15*a*, 15*b* Support shaft
16*a*, 16*b* Rotary knob
20 Operator
33 Sound absorption panel
34 Support frame
35 Panel connection holes

The invention claimed is:

1. An acoustic device comprising:

a housing holding a flat speaker, a first speaker, and a second speaker together as a single unit, wherein the flat speaker is configured to emit sound, from a front side of the acoustic device in a first direction and a rear side of the acoustic device in a second direction opposite the first direction, in a low frequency sound range, and includes:

a flat diaphragm; and at least one actuator mounted to one side of the flat diaphragm, wherein the first speaker is configured to emit sound from the front side of the acoustic device in the first direction, in a mid-to-high frequency sound range, wherein the second speaker is configured to emit sound from the rear side of the acoustic device in the second direction, in one positional state, in the mid-to-high frequency sound range, wherein the second speaker is pivotably mounted to the housing so that the second speaker is pivotable about an axis extending in a direction that is perpendicular to the first direction to adjust a sound emission direction of the second speaker in relation to the front and flat speakers, and wherein the second speaker, in other positional states, emits sound in direction different from the second direction.

2. The acoustic device according to claim 1, further comprising an adjusting circuit configured to adjust a sound emission characteristic of each of the first speaker, the second speaker, and the flat speaker.

3. The acoustic device according to claim 1, wherein the first speaker and the second speaker are arranged back-to-back.

4. The acoustic device according to claim 1, further including:

a sound absorption panel covering the rear side of the acoustic device to cover a rear sound-emitting side of the flat speaker and a front sound-emitting side of the second speaker to adjust sound emission characteristics of sound emitted from the rear side of the acoustic device.

* * * * *